US005615727A

United States Patent [19]

Ollman

[11] Patent Number: 5,615,727

[45] Date of Patent: Apr. 1, 1997

[54] COMPOSITE METAL STRIP AND METHODS OF MAKING SAME

[76] Inventor: Melvin L. Ollman, 841 S. Heathwood Dr., Marco Island, Fla. 33937

[21] Appl. No.: 394,406

[22] Filed: Feb. 24, 1995

[51] Int. Cl.[6] ..... B22D 19/16; B22D 11/06

[52] U.S. Cl. ..... 164/98; 164/461

[58] Field of Search ..... 164/98, 461, 419, 164/472, 268

[56] References Cited

U.S. PATENT DOCUMENTS

| | | | |
|---|---|---|---|
| 3,406,737 | 10/1968 | Duflot et al. | 164/461 |
| 4,224,978 | 9/1980 | Klein | 164/461 |

FOREIGN PATENT DOCUMENTS

| | | | |
|---|---|---|---|
| 4112000 | 9/1992 | Germany | 164/98 |
| 53-2339 | 1/1978 | Japan | 164/461 |
| 59-156542 | 9/1984 | Japan | 164/461 |
| 59-185553 | 10/1984 | Japan | 164/461 |
| 61-172655 | 8/1986 | Japan | 164/461 |

*Primary Examiner*—Joseph J. Hail, III
*Assistant Examiner*—I.-H. Lin
*Attorney, Agent, or Firm*—Richard R. Mybeck

[57] ABSTRACT

A method and apparatus for the continuous casting of composite metal members wherein molten metal is directly cast between two spaced generally parallel metal strips to form a composite member having enhanced surface qualities, formability, and strength. The method comprises feeding at least two strips of metal into a cooled mold system while pouring a molten stream of metal therebetween and forming a composite member by cooling in the cooled mold system until the composite is solidified at the exit point, removing the composite from the cooled mold system and rolling the cooled composite to obtain a desired final thickness. Multiple strip and thin coating methods and apparatus are also disclosed.

12 Claims, 2 Drawing Sheets

COMPOSITE METAL STRIP AND METHODS OF MAKING SAME

This invention relates generally to composite metal strips and sheets and to methods and apparatus for making the same. More particularly, the invention concerns casting molten metal between two adjacent moving cold-rolled strips of metal and fusing said metal and said strips to form a composite structure. In optimal practice, a light metal coating may be applied to one or both sides of the composite metal member.

BACKGROUND OF THE INVENTION

Current best commercial practice in manufacturing steel strip and sheet is the continuous casting of thin slabs. These slabs are then hot-rolled to a thickness which can be coiled, so-called "Hot Band". Hot Band is subsequently de-scaled of its oxidized surfaces by pickling in an acid bath or by shot blasting. Following this operation, the de-scaled band is cold-rolled to usable commercial gauges. Non-ferrous metals are processed in similar fashion from slab or billet without the need for de-scaling.

Efforts to avoid the hot-mill portion of the above procedure have led to thin strip casting processes. These processes, in general, have cast surfaces which lack the fine quality required by the manufactured products in which they are used even after further rolling. Steel sheet, in particular, not only needs a fine surface but in many final uses must also be protected -from destructive corrosion by coating or plating the surfaces with protective metal coatings.

The current commercial practice of hot-rolling and then cold-rolling to final usable gauge, in addition to hot-mill costs, gives rise to an additional problem. This problem is known as "shape". The many rolling passes required to reduce the slab to final usable gauge results in distortions to the surface caused by variations in thickness across and along the length of the strip. These variations are caused by roll deflection and temperature variations during processing.

The present invention resolves the problem of surface quality by casting molten metal between two moving bands of cold-rolled strip which already possess the requisite surface quality. Fears by the steel industry that their cast strip would have large grain which could not be reduced sufficiently by the few roll passes required to reach usable gauges have proven to be without foundation. The cast grain size in thin cast strip has proven to be much smaller than anticipated and capable of being reduced to the fine grain necessary for strength and formability. Shape problems are minimized by reducing the number of roll passes required to obtain usable cold-rolled gauges.

Inherent in the casting process of this invention is the ability to coat or plate the cast strip directly with other metals. Thus, the final rolled product is ready for use in corrosive applications without further coating or plating. Current methods for coating or plating involve hot dipping the rolled product in molten metal or electro-plating it with other metals.

The coating made possible by this invention is of uniform thickness and variable to meet the required specification for type and thickness of the final product coating. The current hot dip process results in a variable coating thickness. Electro-plating is generally not economic for thicker coatings.

Approximately 10% of finished cold-rolled product is used in producing the cast product in this invention. This is a very small process cost to pay to eliminate the hot-mill and de-scaling necessary in current production of cold-rolled strip and sheet. The ability to coat while casting and the improved quality of that coating provides a welcome bonus for the industry.

BRIEF SUMMARY OF THE INVENTION

The method of the present invention comprises feeding thin metal strips by means of one or more rollers into the opposite sides of a cooled mold. The cooled molds may optionally be comprised of one or more cooled drum molds. In the single drum case, the opposite mold may be curved to conform generally with the circumference of the drum mold. The molten metal is poured between the metal strips as the strips enter the cooled mold in a continuous fashion, thereby casting the molten metal between the strips and bonding it to the adjacent metal strips to form a composite member. In one embodiment of this invention, this composite member may be additionally coated with a fine layer of another metal by delivering onto the surface of the composite member a coating metal as a dry powder or from a slurry in which the powdered metal is mixed, the metal having a melting point which is not necassarily the same as; the molten casting metal. The cooled mold is of sufficient length to allow the molten metal to fully solidify at which point the strip is passed through a pair of pinch rollers and then rolled to the final thickness.

Accordingly, the principal object of the present invention is to provide an improved method and apparatus for the continuous casting of composite metal strips.

Another object of the present invention is to provide an improved method and apparatus for casting metal which results in an improved light gauge product.

A further object of the present invention is to provide a novel and unique method of producing composite metal strips using a casting process.

Still an additional object of the present invention is to provide a relatively simple and cost effective method of producing a composite metal strip without hot-rolling and subsequent pickling or shot blasting to remove scale before cold-rolling.

Another object of the invention is to provide a novel and unique substitute method for electro-plating or hot dipping in a molten metal to provide a protective coating.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

DESCRIPTION OF THE PREFERRED EMBODIMENTS

Figure 1:
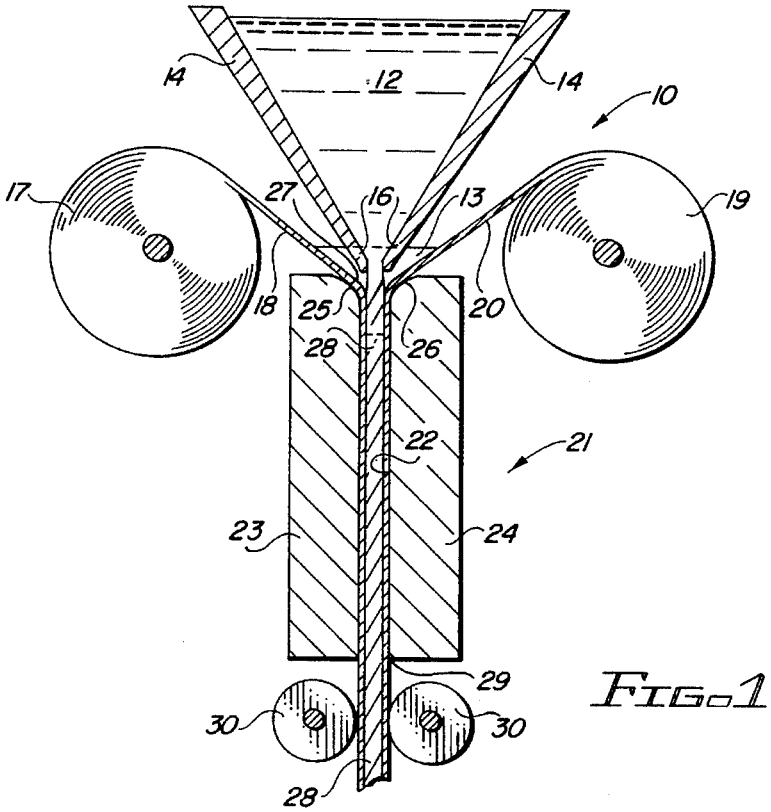
FIG. 1 is a schematic of the basic apparatus for directly casting molten metal directly between two moving strips of metal to form a composite metal structure in accordance with the present invention.

Referring to the drawings, and in particular to FIG. 1, a casting system embodying the present invention is identified by the general reference numeral 10. Molten metal 12 is supplied to casting system 10 from tundish 14. Pour spout 16 of tundish 14 is positioned between dams 13, a first coil 17 which supplies a left strip of metal 18 and a second coil 19 which supplies a right strip of metal 20. Metal strips, 18 and 20, are fed from coils, 17 and 19, into cooled mold system 21 in spaced relationship to each other and coact with dams 13 to form a channel 22 therebetween. Cooled mold system 21 comprises a left portion 23 and a right portion 24, each portion being roughly rectangular but having curved edges 25 and 26 at the entry point 27 of cooled mold system 21. Cooled mold system 21 is of sufficient length and temperature so that the sandwich 28 produced thereby is solid at the point of exit 29. Molten metal 12 is allowed to flow at design rate and reacts upon contact with metal strips, 18 and 20, heating the interior portion of cold-rolled metal strips, 18 and 20, sufficiently to bond at the interfaces. Sandwich 28 is then passed through pinch rollers 30 and to the rolling mill which may reduce it to 10% of cast thickness. The suitable side dams 13, (shown in phantom) are disposed transversely at each edge of strips 18, 20 in operative relationship to pour spout 16 and mold entry point 27 to guide molten metal 12 into channel 22 without spillage. The placement of dams 13 is controlled by the width of strips 18, 20. During original start-up, the leading edges of coils 17, 19 are bent inwardly into substantial contact with each other to arrest the initial flow of molten metal 12 therebetween and facilitate the filling of channel 22 between strips 18, 20. As a further precaution, graphite will be deposited between dams 13 and mold system 21 to prevent leakage therebetween.

Figure 2:
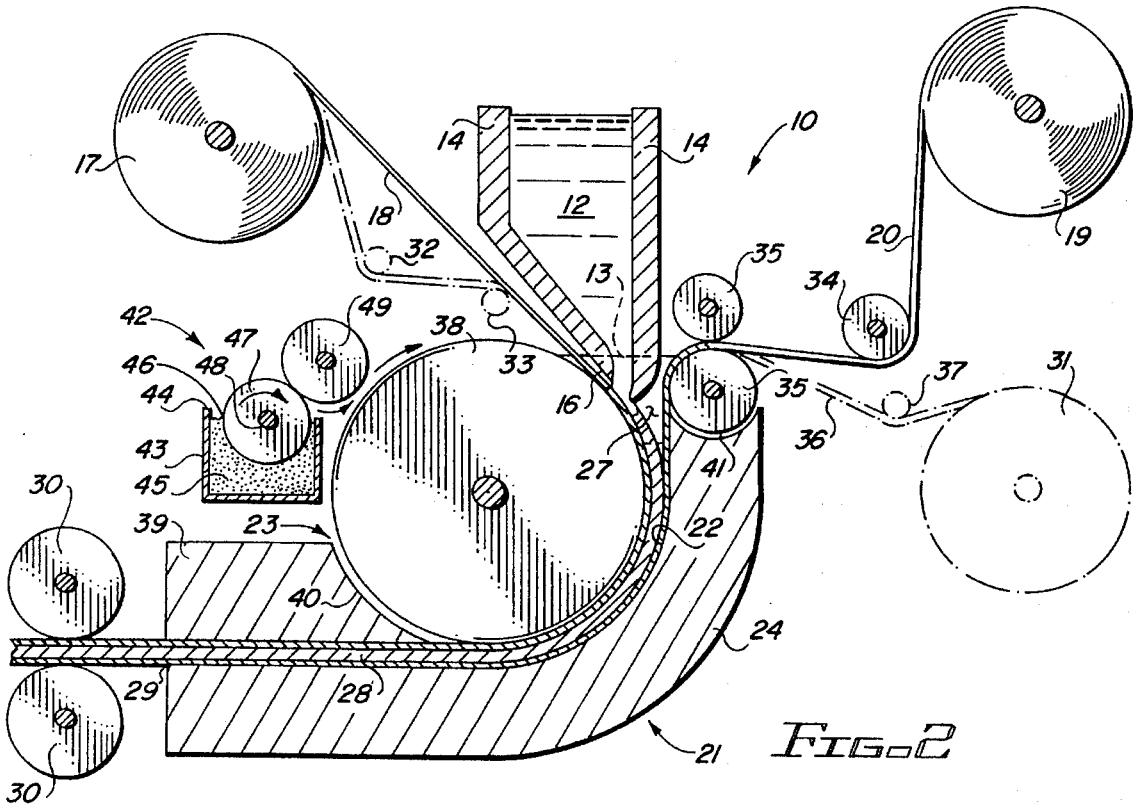
FIG. 2 is a schematic of an alternative embodiment of the present invention in which the composite metal structure is coated in accordance with the present invention.

Another embodiment of the present invention is shown in FIG. 2 and comprises casting system 10 in which molten metal 12 is supplied by tundish 14. First coil 17 of cold-rolled metal is disposed to the left (relative to the drawing) of tundish 14 while second coil 19 is disposed to the right of tundish 14 and coact with dams 13 to define channel 22. First coil 17 provides left strip of metal 18 which is fed into cooled mold system 21. Second coil 19 provides a right strip of metal 20 which is fed through a series of feed rollers which comprises at least one right preliminary feed roller 34 and a right final feed roller 35. Right strip of metal 20 is then fed into cooled mold system 21.

As shown in FIG. 2, cooled mold system 21 comprises a left portion 23 and a right portion 24. Left portion 23 comprises a cooled drum 38 and a cooled mold 39 which is disposed in a near adjacent operative relationship to cooled drum 38 and further comprises a first surface 40 which is shaped to conform generally to the contour of cooled drum 38. Right portion 24 is contoured so as to form uniform channel 22 between left portion 23 and right portion 24. Channel 22 is provided with a substantially uniform width from mold entry point 27 where molten metal 12 enters channel 22 to the point of exit 29. Additionally, right portion 24 has a leading edge 41 which is shaped to conform to the contour of right final feed roller 35.

In one practice of the present invention, a plating or thin coating system 42 is disposed in tangential linear alignment with cooled drum 38 and operates in the following fashion. Plating system 42 comprises a bin 43 having a lip 44 formed on the upper edge thereof and containing powdered metal slurry 45 of a suitable coating material 46, a first plating roller 47 mounted on axle 48 and a second plating roller 49. Coating material 46 adheres to the outer surface of first plating roller 47 which, in operation, is partially submerged within slurry 45 until axle 48 is positioned just above lip 44 of bin 43. First plating roller 47 is disposed in tangential linear relationship to second plating roller 49 which in turn is disposed in tangential linear relationship with cooled drum 38. In operation, first plating roller 47 rotates in the same direction as does cooled drum 38. As rotating first plating roller 47 passes through powdered metal slurry 45, coating material 46 adheres to the surface of first plating roller 47 and is transported into contact with second plating roller 49 which rotates in the opposite direction. Upon contact with second plating roller 49, coating material 46 is transferred from first plating roller 47 to the surface of second plating roller 49 and is carried to the point of tangency with cooled drum 38 whereupon coating material 46 is further transferred to cooled drum 38. Cooled drum 38 then carries coating material 46 towards left strip of metal 18 until coating material 46 is deposited between left strip of metal 18 and cooled drum 38. When molten metal 12 is permitted to flow between left metal strip 18 and right metal strip 20, molten metal 12 heats the metal strips, 18 and 20, sufficiently to evaporate the slurry carrier and cause coating material 46 to bind to the outer surface of left metal strip 18 while simultaneously causing metal strips 18, 20, to bind with molten metal 12 to form a composite or "sandwich"-like structure 28. Sandwich 28 passes on through channel 22 as defined by cooled mold system 21. Cooled mold system 21 is of sufficient length and temperature so that when sandwich 28 reaches exit point 29 it is a solid composite structure. Sandwich 28 thus produced is then passed through a pair of pinch rollers 30 to the rolling mill to provide a finished composite structure plated on one surface. When it is desired to provide a protective coating on both strips 18, 20, coating system 42 described above relative to strip 18 can be duplicated (in mirror image) adjacent strip 20.

Figure 3:
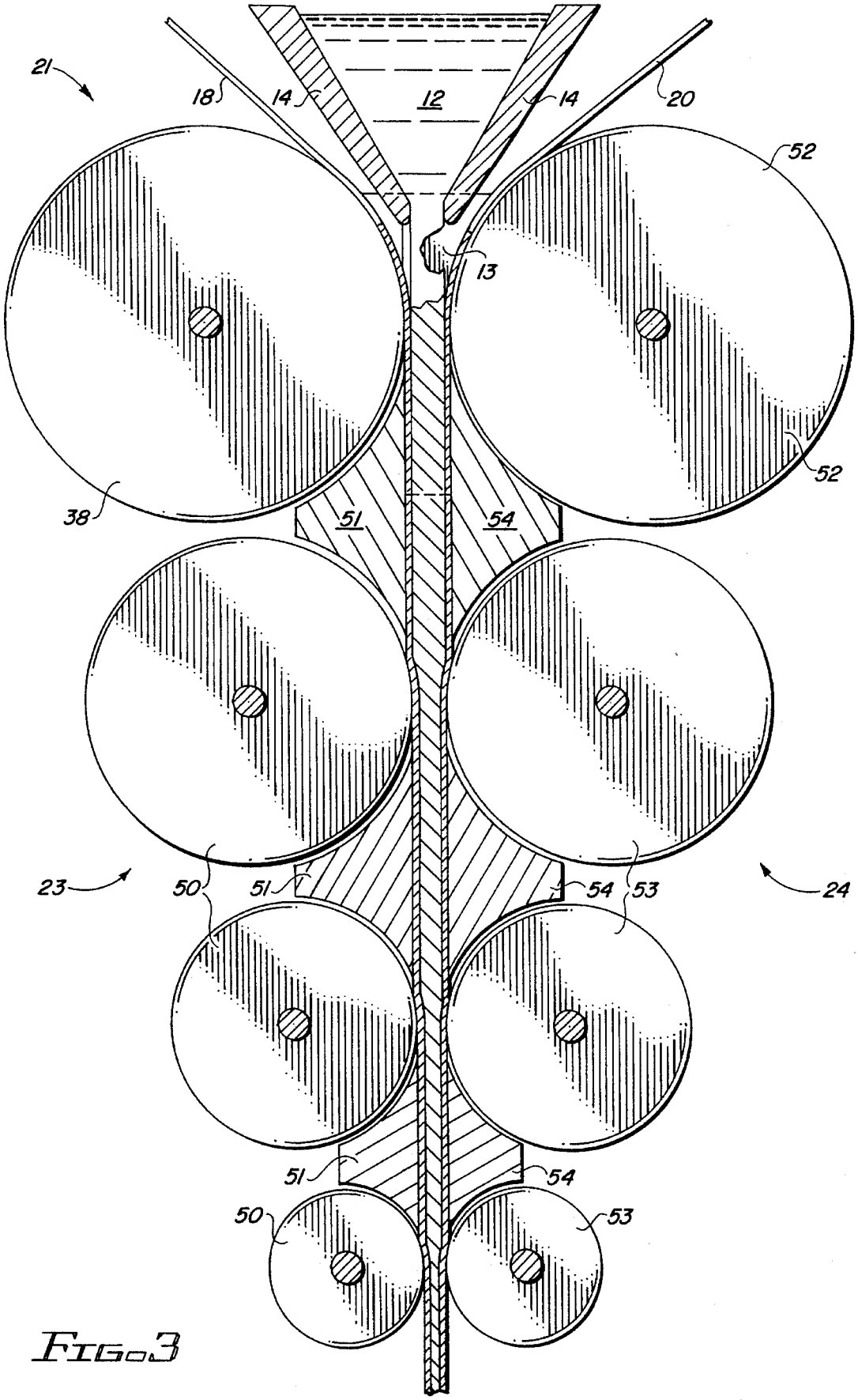
FIG. 3 is a schematic of an alternative embodiment of the invention showing a different cooled mold system.

Another embodiment of the present invention is shown schematically in FIG. 3 and comprises casting system 10 in which molten metal 12 is supplied between dams 13 by tundish 14. First coil 17 of metal is disposed to the left of tundish 14 between dams 13 while a second coil 19 is disposed to the right of tundish 14 between dams 13. First coil 17 provides a left strip of metal 18 and second coil 19 provides a right strip of metal 20. Strips of metal, 18 and 20, are fed into opposite sides of cooled mold system 21 and define channel 22 therebetween. The leading edges of strips 18, 20 are folded inwardly toward each other to define an obstruction to arrest the flow of molten metal 12 therepast during start up. Cooled mold system 21 comprises a left portion 23 and a right portion 24. Left portion 23 further comprises cooled drum 38, a series of cooled rollers 50 which become smaller as sandwich 28 progresses through cooled mold system 21, and a series of cooled molds 51 operatively interposed between said cooled drum 38 and each of the series of cooled rollers 50. Right portion 24 of cooled mold system 21 comprises cooled drum 52, a series of cooled rollers 53 which become smaller as sandwich 28 progresses through cooled mold system 21 and a series of cooled molds 54 operatively interposed between said cooled drum 52 and each of the series of cooled rollers 53. Cooled drum 52 and cooled drum 38 are disposed on opposite sides of channel 22 and are in horizontal alignment with each other. The sequence of right and left cooled rollers, 50 and 53, respectively, are also aligned in pairs on opposite sides of channel 22. Between each pair of rollers 50, 53, channel 22 becomes narrower so that the composite strip formed by casting system 10 is approximately one-half the thickness at exit point 29 than it was at entry point 27. As composite sandwich 28 becomes thinner, its relative speed through the rollers is proportionately increased.

Additionally, when desired, cladding or coating material may be introduced at each level of the casting process. This is achieved by disposing a plating, cladding or thin coating system 42 in tangential linear orientation with any or all of the series of cooled rollers, 50, 53, and cooled drum 38 or cooled drum 52. Plating system 42, as described above, comprises a bin 43 having a lip 44 and a powdered metal slurry 45 of coating material 46 contained therein, a first plating roller 47 having an axle 48 and a second plating roller 49. Coating material 46 adheres to first plating roller 47 which is partially submerged therewithin so that axle 48 is positioned above lip 44 of bin 43. First plating roller 47 is disposed in tangential linear relationship with second plating roller 49 which in turn is disposed in tangential linear relationship to the next unit chosen. For example, if cooled drum 38 is chosen as the only position from which coating material 46 is applied, first plating roller 47 will rotate in the same direction as does cooled drum 38 through powdered metal slurry 45. Coating material 46 adheres to first plating roller 47 until it encounters second plating roller 49 which is rotating in the opposite direction. Upon contact with second plating roller 49, coating material 46 is transferred to second plating roller 49 and is carried to the point of tangency with cooled drum 38 whereupon coating material 46 is transferred to cooled drum 38. Cooled drum 38 then carries coating material 46 towards left strip of metal 18 until coating material 46 is disposed between left strip of metal 18 and cooled drum 38. When molten metal 12 is permitted to flow between left metal strip 18 and right metal strip 20, the molten metal 12 heats metal strips, 18 and 20, sufficiently to evaparate the slurry carriers and cause coating material 46 to be bound to the outer portion of left metal strip 18 while also causing metal strips 18 and 20, to react and bind with molten metal 12. The action of coating material 46 with either or both strips 18, 20 will result in either an alloyed or a sintered strip surface depending on whether the coating metal melts at, below or above the surface temperature of the base or clad metal surface being coated.

A second embodiment of casting system 10 is shown schematically in FIG. 2 and comprises molten metal 12 supplied by tundish 14. First coil 17 of metal is disposed between dams 13 to the left of tundish 14 while second coil 19 is disposed disposed between dams 13 to the right of tundish 14. Additionally, a third and/or fourth coil of metal 31 may also be disposed on the right and left side as is shown in FIG. 2.

First coil 17 provides a left strip of metal 18 which is fed through a series of feed rollers which comprises at least one left preliminary feed roller 32 and a left final feed roller 33 which applies pressure to left strip of metal 18 into the cooled mold system 21 in an even fashion. Second coil 19 provides a right strip of metal 20 which is fed through a series of feed rollers which comprises at least one right preliminary feed roller 34 and a right final feed roller 35. Right strip of metal 20 is then fed into cooled mold system 21. The third and/or fourth coil 31 provides a right secondary strip of metal 36. Right secondary strip of metal 36 is also fed through a series of feed rollers which comprises at least one right secondary feed roller 37 and a right final feed roller 35 and is then fed into cooled mold system 21.

As shown in the drawing, the feeding of the several strips 18, 20, 36 off of coils 17, 19, 31, respectively, into cooled mold system 21 is both facilitated by pressure applied by rollers 32, 33, 34, 35, 37 and 38 and oriented relative to cooled mold system 21.

Cooled mold system 21 in this embodiment comprises a left portion 23 and a right portion 24. Left portion 23 further comprises a cooled drum 38 and a cooled mold 39 which is disposed in a near adjacent relationship to cooled drum 38 and further comprises a first surface 40 which is shaped to conform generally with cooled drum 38. Right portion 24 is shaped so as to form a channel 22 between left portion 23 and right portion 24, said channel 22 having a uniform width from the entry point 27 to the point of exit 29. Additionally, right portion 24 is disposed in a near adjacent relationship to right final feed tension roller 35 and has a leading edge 41 which is shaped to conform with right final tension roller 35. When molten metal 12 is allowed to flow between left metal strip 18 and right metal strip 20, molten metal 12 reacts upon contact with metal strips, 18 and 20, on either side and heats the interior portion of metal strips, 18 and 20, sufficiently to bond at the interfaces therewith forming a sandwich 28. The sandwich 28 thus formed passes through the channel 22. Cooled mold system 21 is of sufficient length and temperature so that sandwich 28 is solid at exit point 29. Sandwich 28 is then passed through pinch rollers 30 and then to the rolling mill for reduction to final thickness.

While the coating described herein is predicated upon the delivery from a slurry of particulate metal, it is understood that a simple dry powder may work equally well under selected circumstances. In addition, a further modification when the economics warrant, would involve the incorporation of one or more coils of strip material outboard of coils 17, 19 and using the same principles as are herein described to overlay strips 18, 20 with still another strip of the special finish material desired without departing from the spirit of this invention.

From the foregoing it becomes readily apparent a new and useful continuous strip casting methods and apparatus have been herein described and illustrated which fulfill all of the aforestated objectives in a remarkably unexpected fashion. It is, of course, understood that many possible embodiments may be made of the various features of the methods and apparatus herein described and that such modifications, alterations and adaptations as will readily occur to the artisan confronted with this disclosure are intended within the spirit of the present invention which is limited only by the scope of the claims appended hereto.

Accordingly, what is claimed is:

1. A method for producing an integral composite metal member comprising the steps of:

(a) feeding a first and a second metal strip in spaced generally parallel relationship to each other into a cooled mold system, said strips defining a channel therebetween;

(b) pouring molten metal into said channel to form a sandwich with said strips;

(c) applying a thin layer of metal onto the outer portion of at least one of said strips;

(d) pressing said thin layer onto said strip; and (e) cooling said coated layered sandwich until said molten metal solidifies.

2. A method according to claim 1 wherein the metal strips are fed into the cooled mold system by a plurality of feed rollers.

3. A method of according to claim 1 in which said thin layer is delivered as dry particulate metal.

4. A method according to claim 3 in which said thin layer is pressed onto said strip by means of a series of rollers.

5. A method according to claim 1 in which said thin layer is delivered as a metal slurry.

6. A method according to claim 5 in which said thin layer is pressed onto said strip by means of a series of rollers.

7. A method according to claim 1 in which said thin layer is delivered as a metal strip.

8. A method according to claim 7 in which said thin layer is pressed onto said strip by means of a series of rollers.

9. A method according to claim 1 comprising the further step of pinch rolling said cooled sandwich to a final thickness.

10. A method according to claim 1 in which said thin layer of metal has a melting temperature lower than the temperature of the strip at point of contact to form a melted coating thereupon which, in response to cooling, solidifies and bonds with said strip.

11. A method according to claim 1 in which said thin layer of metal has a melting temperature higher than the temperature of the strip at point of contact to form a particulate coating upon said strip which sinters and bonds with said strip.

12. A method for producing an integral composite metal member comprising the steps of:

(a) pouring a molten metal into a cooled mold system to form an emerging continuously solidifying case strip;

(b) accepting said emerging solidifying cast strip between cooled rollers disposed on each side of said emerging strip;

(c) allplying a thin layer of metal on one or both sides of said emerging solidifying strip; and (d) pressing said thin layer of metal onto the solidified surface of said strip.

* * * * *